US006318343B1

(12) United States Patent
Nakagawa et al.

(10) Patent No.: US 6,318,343 B1
(45) Date of Patent: Nov. 20, 2001

(54) FUEL PUMP CONTROL SYSTEM FOR AN INTERNAL COMBUSTION ENGINE

(75) Inventors: Norihisa Nakagawa, Numazu; Takayuki Demura, Mishima, both of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/442,388

(22) Filed: Nov. 18, 1999

(30) Foreign Application Priority Data

Nov. 24, 1998 (JP) ..... 10-333098

(51) Int. Cl.[7] ..... F02M 37/04
(52) U.S. Cl. ..... 123/500; 123/90.15
(58) Field of Search ..... 123/90.15, 90.16, 123/90.17, 500, 501, 357, 506, 458, 456

(56) References Cited

U.S. PATENT DOCUMENTS 5,215,061 * 6/1993 Ogawa ..... 123/90.15
5,937,808 * 8/1999 Kako ..... 123/90.15
5,967,125 * 10/1999 Morikawa ..... 123/90.115
6,006,706 * 12/1999 Kanzaki ..... 123/90.15
6,006,725 * 12/1999 Stefanopoulou ..... 123/90.15
6,024,064 * 2/2000 Kato et al. ..... 123/179.17

FOREIGN PATENT DOCUMENTS 8-177592 7/1996 (JP) .
8-270520 10/1996 (JP) .
10-176508 6/1998 (JP) .

* cited by examiner

*Primary Examiner*—Carl S. Miller
(74) *Attorney, Agent, or Firm*—Oliff & Berridge, PLC

(57) ABSTRACT

The fuel pump control system includes an electronic control unit (ECU) for controlling the discharge capacity of a plunger type high pressure fuel pump driven by a driving cam connected to the camshaft of an engine. The engine is provided with a variable valve timing device for controlling valve timing of the engine by adjusting the rotation phase of the camshaft relative to the crankshaft. The pump is provided with a suction valve. When the open/close timing of the suction valve changes, the effective discharge stroke of the pump and, thereby the discharge capacity of the pump changes. The ECU estimates the change in the valve timing of the engine during the effective discharge stroke of the pump before the effective discharge stroke starts, and adjusts the open/close timing of the suction valve in accordance with the estimated change in the valve timing so that the discharge capacity of the pump becomes a target discharge capacity regardless of the change in the valve timing of the engine.

3 Claims, 5 Drawing Sheets

FUEL PUMP CONTROL SYSTEM FOR AN INTERNAL COMBUSTION ENGINE

BACKGROUND OF THE INVENTION

1. Field of the Invention

The present invention relates to a fuel pump control system for an internal combustion engine. More specifically, the invention relates to a fuel pump control system for controlling the capacity of a positive-displacement type fuel pump driven by a camshaft of an internal combustion engine.

2. Description of the Related Art

A common rail type fuel injection system is known in the art. The common rail type fuel injection system includes a common rail (a reservoir) for receiving high pressure fuel and fuel injection valves connected to the common rail for injecting fuel into the cylinders of the engine. Since the injection rate of the fuel injection valves changes in accordance with the fuel pressure in the common rail, the pressure of the fuel in the common rail must be precisely controlled based on the operating condition of the engine in order to achieve a fuel injection rate suitable for the engine operating condition.

The common rail pressure (the pressure of the fuel in the common rail), in general, is controlled by adjusting a discharge capacity (fuel feed amount) of a high pressure fuel supply pump supplying high pressure fuel to the common rail. As a high pressure fuel supply pump, usually a positive-displacement type pump such as a plunger pump driven by a driving cam coupled to the camshaft of the engine and rotating synchronously with the camshaft, is used.

A control system of the fuel pump of this type is disclosed, for example, in Japanese Unexamined Patent Publication (Kokai) No. 8-177592. The control system in the '592 publication utilizes a plunger pump driven by a driving cam being coupled to the engine camshaft and rotates synchronously therewith. The control system in the '592 publication determines a target common rail pressure based on the operating condition of the engine and controls the discharge capacity of the plunger pump in accordance with the target common rail pressure and an actually detected common rail pressure so that the actually detected common rail pressure coincides with the target common rail pressure. The detection of the actual common rail pressure and the discharge of fuel from the pump are performed at every predetermined rotation angle of the crankshaft of the engine.

However, problems may occur if the system in the '592 publication is applied to an internal combustion engine equipped with a variable valve timing device for adjusting the valve timing of the engine in accordance with the engine operating conditions.

In a certain type of variable valve timing device, the valve timing of the engine is adjusted by changing the rotational phase of the camshaft relative to the crankshaft. If the fuel pump control system in the '592 publication is applied to an engine equipped with a variable valve timing device of this type, it becomes difficult to control the discharge capacity of pump, and the common rail pressure cannot be accurately controlled to the target pressure.

Namely, the plunger of the fuel pump in the '592 publication is moved by a driving cam to reciprocate within the cylinder of the pump. The driving cam of the pump is coupled to the camshaft of the engine and rotates synchronously with the camshaft. Therefore, the rotational phase of the driving cam also changes when the rotational phase of the camshaft is changed by the variable valve timing device.

Further, in the system of the '592 publication, discharge of the fuel from the pump is started when the angular position of the crankshaft reaches a predetermined crank rotation angle and the discharge of the fuel continues until the end of the discharge period determined based on a target discharge amount. the discharge period is given by an angle of rotation of the crankshaft. The discharge capacity of the pump is determined by an amount of the effective discharge stroke (i.e., the displacement of the plunger during the discharge period) and, in other words, the amount of change in the cam-lift of the driving cam during the discharge period.

As explained above, since the driving cam of the pump rotates synchronously with the camshaft of the engine, the rotational phase of the driving cam changes when the rotational phase of the camshaft changes. Therefore, when both the crank shaft rotation angle (crank angle) at which the discharge period starts and the crank angle at which the discharge period ends are fixed, the discharge capacity of the pump also changes when the rotational phase of the driving cam relative to the crankshaft changes. This causes a change in the discharge capacity of the pump. Therefore, in the system of the '592 publication, the discharge capacity of the fuel supply pump changes when the valve timing of the engine changes if the discharge period of the pump is fixed.

This problem is illustrated in detail in FIG. 5.

In FIG. 5, the vertical axis represents the cam-lift of the driving cam of the pump and the horizontal axis represents the crank angle. The curve I in FIG. 5 shows the change in the cam-lift of the driving cam when the rotational phase of the camshaft is set to a value where the valve timing of the engine is most retarded, and the curve II shows the same when the rotational phase of the camshaft is set to a value where the valve timing of the engine is most advanced. As can be seen from FIG. 5, the cam-lift curve of the driving cam moves in the direction in which the crank angle advances when the valve timing of the engine advances. In this case, if the start and the end of the discharge period (expressed by crank angles) are fixed, i.e., if the discharge period is fixed at DP1 in FIG. 5, the effective discharge stroke D1 of the pump plunger when the valve timing is most retarded changes to D2 when the valve timing is most advanced. This means that the discharge capacity of the pump cannot be controlled precisely when the valve timing of the engine changes if the pump discharge is controlled, i.e., if the start and end of the discharge period are set in the manner same as that in the fixed valve timing engine. In this case, since an excess or a shortage of the fuel discharge capacity relative to the target discharge capacity occurs, problems such as a deviation in the actual common rail pressure, from the target value, and an increase in the engine power loss due to excessive work of the fuel pump may occur.

SUMMARY OF THE INVENTION

In view of the problems in the related art as set forth above, the object of the present invention is to provide a fuel pump control system for an internal combustion engine capable of precisely controlling the discharge capacity of a fuel pump when a positive-displacement type pump driven by the camshaft of the engine is applied to an engine equipped with a variable valve timing device.

The object as set forth above is achieved by a fuel pump control system for an internal combustion engine according to the present invention. The engine is provided with variable valve timing setting means for adjusting the valve timing of the engine to a target valve timing determined by the operating condition of the engine by changing a rotational phase of the camshaft of the engine. The fuel pump control system comprising a discharge capacity control means for controlling the discharge capacity of a positive-displacement type fuel pump, which operates synchronously with the rotation of the camshaft of the engine, to a predetermined target discharge capacity and the discharge capacity control means controls the discharge capacity of the fuel pump to the predetermined target discharge capacity by changing the timing of at least one of the start and the end of an effective discharge stroke of the pump in accordance with the change in the valve timing of the engine.

According to the present invention, at least one of the start timing and the end timing of the effective discharge stroke of the pump (i.e., crank angles at which the effective discharge stroke of the pump starts and ends) is changed in accordance with the change in the valve timing of the engine, i.e., in accordance with the change in the rotational phase of the camshaft relative to the crankshaft. Therefore, it becomes possible to control the length of the effective discharge stroke of the pump in such a manner that the pump discharge capacity is maintained ax the target discharge capacity regardless of the change in the rotational phase of the camshaft.

BRIEF DESCRIPTION OF THE DRAWINGS

The present invention will be better understood from the description, as set forth hereinafter, with reference to the accompanying drawings in which.

DESCRIPTION OF THE PREFERRED EMBODIMENT

Hereinafter, an embodiment of the fuel pump control system according to the present invention will be explained with reference to FIGS. 1 through 5.

Figure 1:
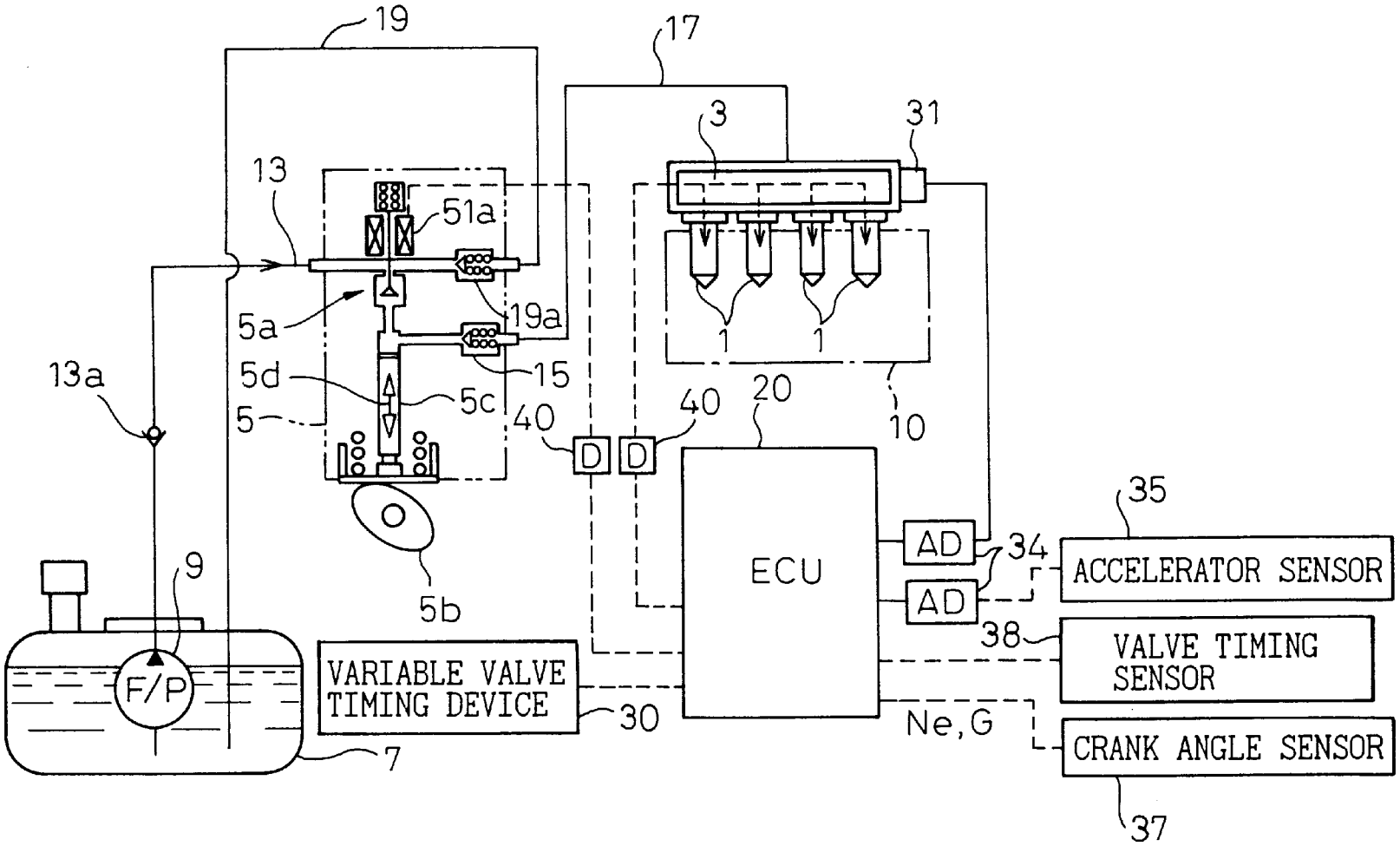
FIG. 1 shows a general configuration of an embodiment of the present invention when it is applied to an automobile engine provided with a common rail and a variable valve timing device.

FIG. 1 schematically shows the general configuration of an embodiment of the present invention when it is applied to an automobile engine.

In FIG. 1, reference numeral 10 designates an internal combustion engine as a whole. In this embodiment, a four-cylinder gasoline engine is used for the engine 10. Reference numeral 1 in FIG. 1 shows fuel injection valves which inject fuel directly into the respective cylinder of the engine 10. The fuel injection valves 1 are connected to a common reservoir (a common rail) 3. The common rail 3 acts as a reservoir for storing pressurized fuel supplied from a high pressure fuel pump 5 which is explained later, and for distributing the high pressure fuel to the respective fuel injection valves 1. In FIG. 1, numeral 7 denotes a fuel tank for storing fuel for the engine 10, numeral 9 denotes a low pressure fuel feed pump for feeding fuel to the high pressure fuel pump 5. During the engine operation, fuel in the fuel tank 7 is pressurized to a predetermine relatively low pressure by the low pressure fuel feed pump 9 and supplied to the high pressure fuel pump 5 through a low pressure fuel line 13 and a check valve 13*a* disposed thereon. Fuel is further pressurized by the high pressure fuel pump 5 and supplied to the common rail 3 through a check valve 15 and a high pressure fuel line 17 and, from the common rail 3, fuel is supplied to the fuel injection valves 1 and injected into the respective cylinders of the engine 10.

Numeral 19 is a spill line and 19*a* is a check valve disposed thereon. The spill line 19 returns the fuel discharged from a suction valve 5*a* of the high pressure fuel pump 5 during the discharge stroke of the plunger of the pump 5 as explained later. The high pressure fuel pump 5 and the suction valve 5*a* will be explained later in detail.

Numeral 20 in FIG. 1 is an electronic control unit (ECU) 20 of the engine for controlling the engine 10. The ECU 20 in this embodiment is a microcomputer of a known design comprising a read-only memory (ROM), random-access memory (RAM) a microprocessor (CPU) and input and output ports, all connected each other by a bi-directional bus. The ECU 20 in this embodiment acts as a discharge capacity control means and controls the fuel pressure in the common rail 3 to a target common rail pressure determined as a function of the engine load and speed. As explained later, the ECU 20 controls the amount of fuel supplied from the pump 5 to the common rail in accordance with the engine load, speed and common rail pressure by adjusting the open/close operation of the suction valve 5*a* of the pump. By the function of the ECU 20 as the discharge capacity control means, the injection rate of the fuel injection valves is adjusted in accordance with the engine operating conditions such as the engine load and engine speed. Further, the ECU 20 performs fuel injection control in which the timing of opening and closing of the fuel injection valve 1 is controlled in order to adjust the fuel injection amount and fuel injection timing in accordance with the operating condition of the engine.

In this embodiment, the engine 10 is equipped with a variable valve timing device 30. The variable valve timing device 30 changes the valve timing of the engine, i.e., the timing of opening and closing of intake valves or exhaust valves, or both in accordance with the operating condition of the engine. A known type variable valve timing device which changes the valve timing by changing the phase of the rotation of the camshaft relative to the rotation of the crankshaft is used as the variable valve timing device 30 in this embodiment.

The camshaft is driven by the crankshaft and rotates synchronously with the crankshaft. In a conventional engine, since the rotational phase of the camshaft with respect to the crankshaft is fixed the valve timing of the intake and exhaust valves (crank angles at which the valves open and close) is fixed. However, the variable valve timing device 30 in this embodiment changes the valve timing by changing the rotational phase of the camshaft with respect to that of the crankshaft while the camshaft rotates synchronously with the crankshaft during the engine operation. For example, when the rotational phase of the camshaft is advanced with respect to the crankshaft, the opening and closing timing of both intake and exhaust valves are also advanced. When the rotational phase of the camshaft is retarded with respect to the crankshaft, the opening and closing timing of both valves are also retarded.

In order to perform various controls explained above, a voltage signal corresponding to the fuel pressure in the common rail 3 is supplied to the input port of the ECU 20 via an AD converter 34 from a fuel pressure sensor 31 disposed on the common rail 3. The fuel pressure signal is used as a parameter representing the operating condition of the high pressure fuel pump 5. Further, a signal corresponding to the amount of depression of an accelerator pedal (an accelerator opening) of the engine is also supplied to the input port of the ECU 20 via the AD converter 34 from an accelerator sensor 35 disposed near the accelerator pedal (not shown). The accelerator opening signal is used as a parameter representing the engine load. As the engine load parameter, other parameters such as an intake air amount or an intake air pressure of the engine, instead of the accelerator opening may be used.

A crank angle sensor 37 is disposed near the crankshaft of the engine 10. The crank angle sensor generates a reference crankshaft position signal every time when the crankshaft reaches a predetermined reference position (for example, a top dead center of the No. 1 cylinder of the engine) during its rotation and a crank rotation angle signal at every predetermined rotation angle of the crankshaft (for example, 15° CA). The reference crankshaft position signal and the crank rotation angle signal are supplied to the input port of the ECU 20 and used for calculating the engine rotational speed and for determining the open and close timing of the suction valve 5*a* of the high pressure fuel pump 5.

Further, in this embodiment, a valve timing sensor 38 which generates a reference camshaft position signal every time when the camshaft reaches a predetermined reference position during its rotation is disposed near the camshaft of the engine 10. The reference camshaft position signal is supplied to the input port of the ECU 20. The ECU 20 calculates the rotation phase of the camshaft (i.e., the valve timing of the engine 10) based on the difference between the reference camshaft position signal from the valve timing sensor 38 and the reference crankshaft position signal from the crank angle sensor 37.

The output port of the ECU 20 is connected to the respective fuel injection valves 1 via a drive circuit 40 in order to control the open and close timing (i.e., the fuel injection amount and the fuel injection timing) of the fuel injection valves 1. The output port of the ECU 20 is further connected to a solenoid actuator 51*a* of the suction valve 5*a* of the high pressure fuel pump 5 via the drive circuit 40 in order to control the discharge capacity of the pump 5. In addition to that, the output port of the ECU 20 is connected to the variable valve timing device 30 of the engine in order to control the valve timing of the engine 10 in accordance with the engine operating condition such as the engine load and speed.

In this embodiment, the high pressure fuel pump 5 is a plunger pump provided with a plunger 5*d* that is driven by a driving cam 5*b* to reciprocate within a cylinder 5*c* of the pump 5. The driving cam 5*b* is formed at the end of the camshaft of the engine 10. As explained before, the camshaft in this embodiment is driven by the crankshaft of the engine and rotates synchronously therewith. Therefore, the high pressure fuel pump 5 in this embodiment operates synchronously with the rotation of the camshaft. Since the driving cam 5*b* in this embodiment has two nose portion, the high pressure fuel pump 5 discharges fuel two times per one rotation of the driving cam 5*b*. Since the driving cam 5*b* and the camshaft of the engine rotates one times per two rotations of the crankshaft, the high pressure fuel pump 5 discharges fuel once per a rotation of the crankshaft.

The suction valve 5*a* that is operated by a solenoid actuator 51*a* is provided on an inlet port of the cylinder 5*c*. The ECU 20 controls the discharge capacity of the pump 5 by changing timing and period for opening the suction valve 5*a* during the discharge stroke of the plunger 5*d*.

Figure 2C:
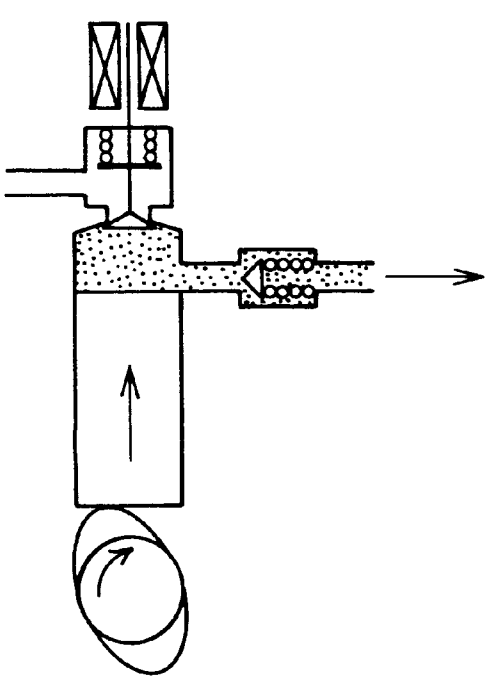
FIGS. 2A, 2B and 2C schematically illustrate the method for controlling the discharge capacity of the high pressure fuel supply pump in FIG. 1.
Figure 2B:
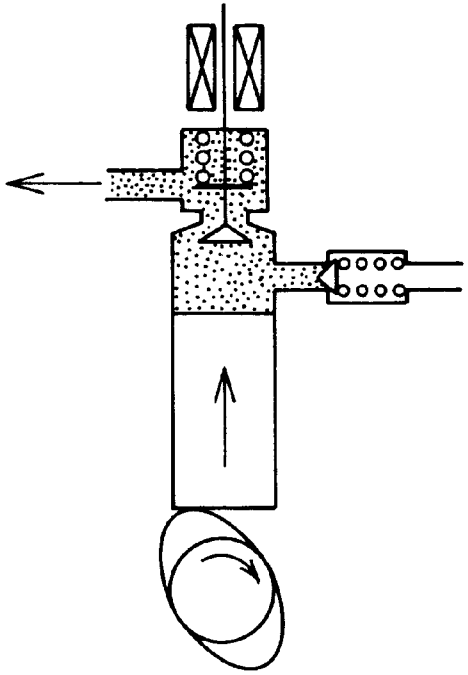
Figure 2A:
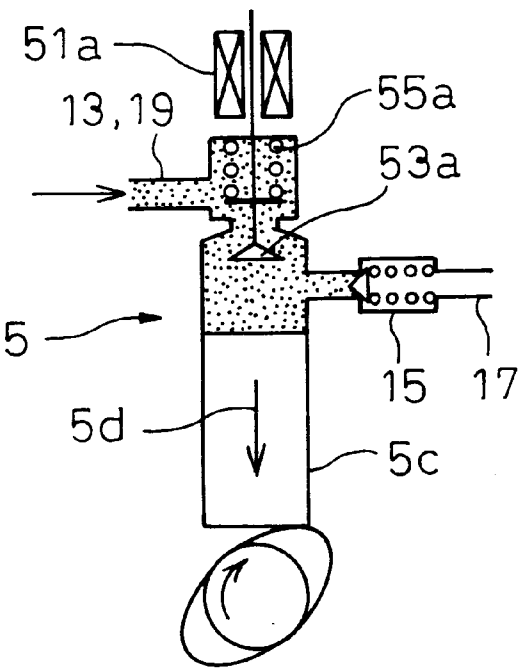

FIGS. 2A through 2C schematically illustrate the method for controlling the discharge capacity of the pump by the suction valve 5*a*. FIG. 2A shows the pump 5 when the plunger is moving downward (i.e., when the pump 5 is in a suction stroke). FIG. 2 shows the pump 5 when the plunger 5*d* is moved by the driving cam 5*b* to the upward direction (i.e., when the pump 5 is in the discharge stroke). FIG. 2C shows the pump 5 when it is in an effective discharge stroke in which the pump 5 actually discharges fuel.

As can be seen from FIGS. 2A and 2B, the ECU 20 de-energizes the solenoid actuator 51*a* during the suction stroke and a predetermined period after the discharge stroke of the pump starts. When the solenoid actuator 51*a* is de-energized, the valve body 53*a* of the suction valve 5*a* is kept at the opening position being urged by the spring 55*a*. Therefore, in the suction stroke (FIG. 2A), fuel flows into the cylinder 5*c* from the low pressure line 13 as the plunger 5*d* moves to downward direction. Further, since the suction valve 5*a* is maintained at its opening position at the beginning of the discharge stroke (FIG. 2B), fuel in the is discharged through the suction valve 5*a* back to the low pressure line 13 returns to the fuel tank 7 through the spill line 19 and the check valve 19*a* (FIG. 1) when the plunger 5*d* moves upward direction at the beginning of the discharge stroke. Therefore, even if the discharge stroke of the pump starts, the pressure of the fuel in the cylinder 5*c* does not rise and fuel is not discharged from the pump 5 into the high pressure line 17 as long as the suction valve 5*a* is maintained at the opening position. When a predetermined period passes after the discharge stroke starts, the ECU 20 energizes the solenoid actuator 51*a* of the suction valve 5*a*. This causes the solenoid actuator 51*a* to move the valve body 53*a* against the urging force of the spring 55*a* and, thereby, the valve body 53*a* moves to its close position (FIG. 2C). When the suction valve 5*a* closes during the discharge stroke of the pump 5, the pressure in the cylinder increases due to the upward movement of the plunger 5*d* and, when the pressure of the fuel in the cylinder 5*c* becomes higher than the pressure of the fuel in the common rail 3, the check valve 15 of the cylinder 5*c* opens and the fuel in the cylinder 5*c* is flows into the common rail 3 through the check valve 15 and the high pressure line 17. Namely, when the solenoid actuator 51*a* is energized during the discharge stroke of the pump 5, the effective discharge stroke of the pump 5 in which fuel is actually discharged from the pump is initiated. Further, when a predetermined time has elapsed after the effective discharge stroke started, the ECU 20 again de-energizes the solenoid actuator 51*a*. This causes the valve body 53*a*, being urged by the spring 55, to move to its open position (FIG. 2B). Thus, the pressure of the fuel in the cylinder 5*c* decreases since the fuel in the cylinder 5C flows back to the fuel tank 7 through the suction valve 5*a* and the discharge of fuel into the high pressure line 17 is terminated. Namely, the effective discharge stroke of the pump 5 terminates when the solenoid actuator 51*a* is de-energized during the discharge stroke of the pump 5.

The amount of fuel discharged from the pump 5 during its effective discharge stroke (i.e., discharge capacity of the pump 5) is proportional to the amount of upward displacement of the plunger 5*d* during the effective discharge stroke. In other words, the discharge capacity of the pump 5 is proportional to the amount of the change in the cam lift of the driving cam 5*b* during the effective discharge stroke. Therefore, the discharge capacity of the pump 5 can be controlled by adjusting the open/close timing of the suction valve 5*a* (i.e., energizing/de-energizing timing of the solenoid actuator 51*a*.)

In this embodiment, the ECU 20 determines the target common rail pressure based on the engine load and engine speed using a predetermined relationship stored in the ROM and further determines a target discharge capacity of the high pressure fuel pump 5 based on the target common rail pressure and the actual common rail pressure detected by the fuel pressure sensor 31. The target discharge capacity of the pump 5 is the discharge capacity required for making the actual common rail pressure coincide with the target common rail pressure. After determining the target discharge capacity of the pump 5, the ECU 20 sets the close/open timing of the suction valve 5*a* (energizing/de-energizing timing of the solenoid actuator 51*a*) so that the actual discharge capacity of the pump 5 becomes the same as the calculated target discharge capacity.

If a fixed valve timing engine, in which the rotational phase of the camshaft relative to the crank shaft is always fixed, is used, the discharge capacity of the pump 5 is always the same if the period of the effective discharge stroke of the pump is fixed, i.e., if the opening timing of the suction valve (the crank angle at which the suction valve opens) and the closing timing of the suction valve (the crank angle at which the suction valve closes) are fixed. However, in a variable valve timing engine (i.e., an engine equipped with a variable valve timing device), the discharge capacity of the pump changes as the valve timing of the engine changes if the effective discharge stroke is fixed, as explained in FIG. 5.

The ECU 20 in this embodiment adjusts the point at which the effective discharge stroke starts and the length thereof in accordance with the valve timing of the engine 10 so that the actual discharge capacity coincides with the calculated target discharge capacity.

Figure 5:
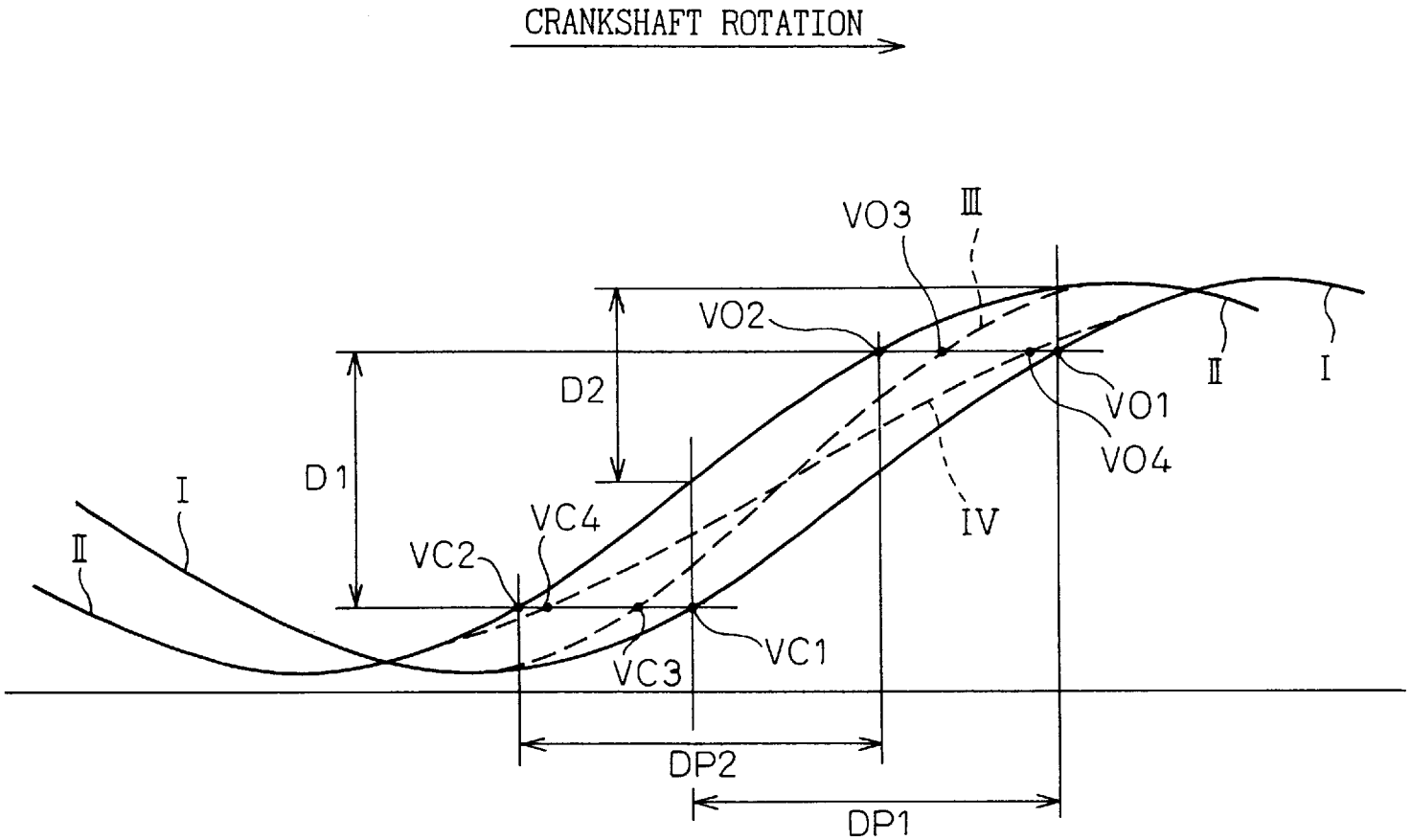
FIG. 5 is a diagram showing a change in the pump discharge capacity due to the change in the valve timing of the engine.

As explained above, the discharge capacity of the high pressure fuel pump 5 is determined by the amount of the displacement of the plunger 5*d* during the effective discharge stroke of the pump. In other words, the discharge capacity of the pump 5 is determined by the difference between the cam lift of the driving cam 5*b* at the start of the effective discharge stroke (i.e., at the time when the suction valve 5*a* closes) and the end of the effective discharge stroke (i.e., at the time when the suction valve opens). Therefore, the discharge capacity of the pump 5 can be kept unchanged, for example, as indicated by the curves I and II in FIG. 5, by adjusting the effective discharge stroke period in such a manner that the change in the cam lift of the driving cam 5*b* becomes the same (for example, D1 in FIG. 5) even if the valve timing changes. Namely, in FIG. 5 if the effective discharge stroke period is set at the period shown by DP2, the change in the cam lift during the effective discharge stroke, and thereby the discharge stroke of the pump 5, can be kept at a same value even when the valve timing of the engine is advanced from curve I to curve II. As indicated in FIG. 5, the effective discharge stroke starts at a crank angle VC1 and ends at a crank angle VO1 when the valve timing is shown by the curve I in FIG. 5 (the most retarded valve timing). When the valve timing is advanced from curve I to curve II (the most advanced valve timing), if the effective discharge stroke is set in such a manner that it starts at a crank angle VC2 and ends at a crank angle V02, the amounts of the cam lift at the start and the end of the effective discharge stroke, and the difference D1 therebetween are kept at a same value.

In this embodiment, after calculating the target discharge capacity of the pump 5, the ECU 20 calculates the required close/open timing (i.e., crank angles VC1 and VO1) of the suction valve 5*a* when the valve timing of the engine 10 is in a reference condition (for example, the most retarded timing indicated by the curve I in FIG. 5). Then the ECU 20 calculates the actual close/open timing of the suction valve (for example, VC2 and V02) in the current valve timing (for example, curve II in FIG. 5) required for obtaining the amounts of the cam lift same as those at VC1 and VO1 in the reference valve timing (curve 1). Namely, the ECU 20 sets the period of effective discharge stroke so that the positions of the rotation of the driving cam 5*b* at the start and the end of the effective discharge stroke in the current valve timing become the same as those in the reference valve timing.

However, in the transient condition, i.e., when the valve timing is changing, it is difficult to determine the actual close/open timing VC2 and V02 of the suction valve 5*a*. For example, when the valve timing changes from the most retarded timing (the curve I in FIG. 5) to the most advanced timing (the curve II in FIG. 5), the cam lift curve does not switch from the curve I to the curve II immediately. In the actual operation of the engine, since the operation speed of the variable valve timing device is limited, the valve timing changes from the most retarded timing (curve I) to the most advanced timing (curve II) at a relatively low speed. In this case, during the transient period from the curve I to curve II, the actual cam lift of the driving cam 5*b* changes along a transient curve indicated by the curve III in FIG. 5. Conversely, when the valve timing changes from the most advanced timing (curve II) to the most retarded timing (curve I) in FIG. 5, the actual cam lift of the driving cam 5*b* changes along another transient curve indicated by IV in FIG. 5. Therefore, in order to adjust the discharge capacity during the transient period in which the valve timing is changing, it is necessary to determine the crank angles (the rotation phase of the driving cam 5*b*) at which the amounts of the cam lift of the driving cam 5*b* actually become the same as those at VC1 and V01 in the reference valve timing. For example, in FIG. 5, the required timings of the suction valve close/open during the transient condition are VC3 and V03 when the valve timing is changing from curve I (the most retarded timing) to curve II (the most advanced timing) and, VC4 and V04 when the valve timing is changing from curve II to curve I. Further, the cam lift curve III and IV only show the transient between the most retarded valve timing (curve I) and the most advanced valve timing (curve II). Therefore, in the transient condition between valve timings other than the most retarded and the most advanced valve timing, different transient curves must be used to determine the actual close/open timing of the suction valve 5*a*. Further, since the actual close/open timing of the suction valve 5*a* must be determined simultaneously with the determination of the target discharge capacity of the pump, the close/open timing of the suction valve 5*a* must be determined before the effective discharge stroke starts.

Therefore, in this embodiment, when calculating the discharge capacity of the pump, the ECU 20 estimates the future valve timing when the suction valve actually closes and opens, and determines the precise close open timing of the suction valve 5*a* based on the estimated valve timing and the calculated target discharge capacity of the pump.

The method for determining the close/open timing of the suction valve (i.e., the method for controlling the discharge capacity of the pump 5) will be explained with reference to the flowchart in FIG. 3 and the timing diagram in FIG. 4.

Figure 4:
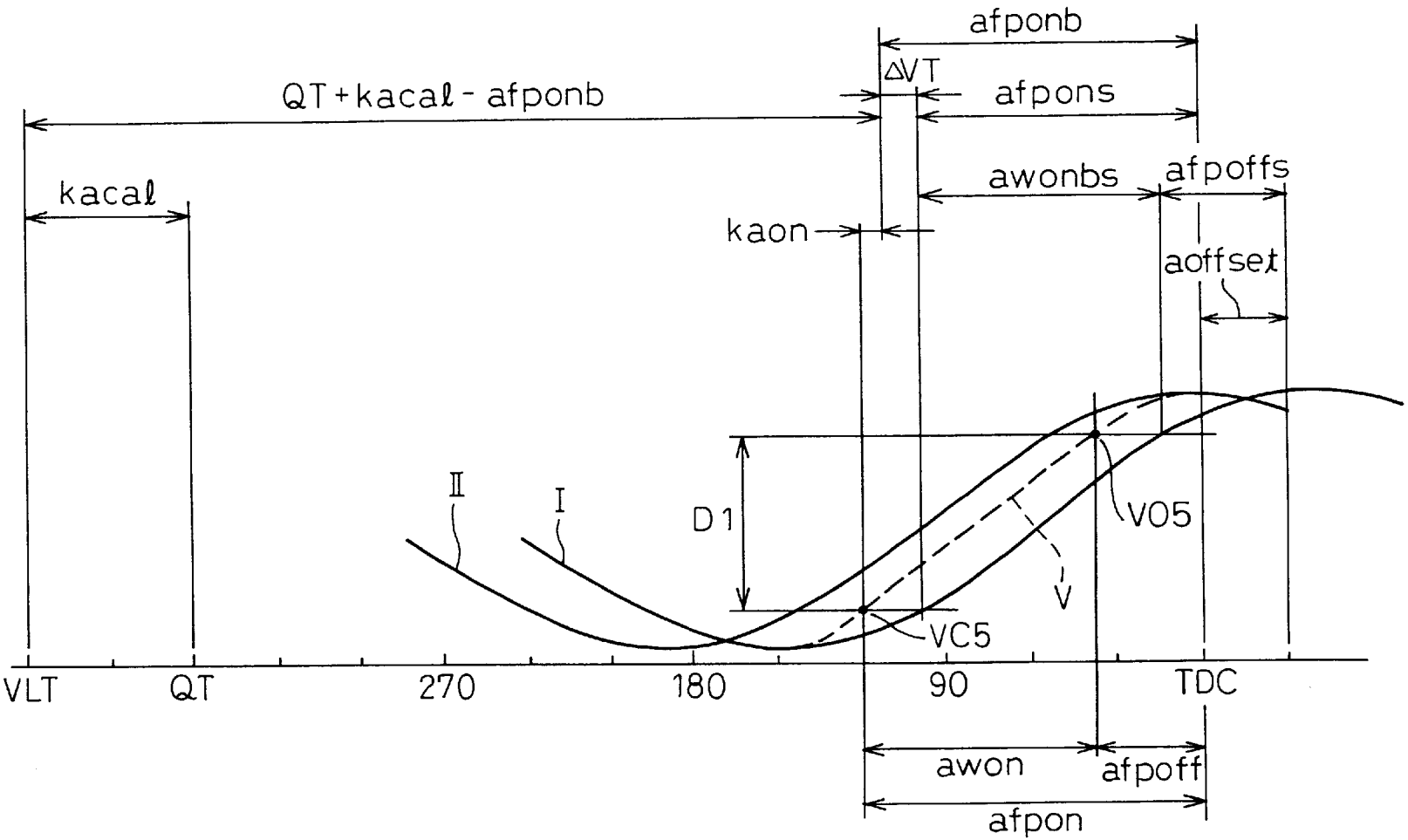
FIG. 4 is a timing diagram explaining the control operation in FIG. 3.

FIG. 4 is a diagram similar to that in FIG. 5 which illustrates the cam lift curve of the driving cam 5*b* of the pump 5. The horizontal axis in FIG. 4 represents crank angle and the vertical axis represents the amount of the cam lift of the driving cam 5*b*. The curve I in FIG. 4 represents the cam lift curve of the driving cam 5*b* when the valve timing is mot retarded, and the curve V represents an exemplary cam lift curve of the driving cam 5*b* during a transition when the valve timing is changing from one valve timing to another. The crank angle (the horizontal axis) in FIG. 4 is expressed by the crank angle to the reference crank position TDC (for example, the top dead center of the No. 1 cylinder). The crank angle in FIG. 4 is expressed as BTDC value, and the timing advances as the value of the crank angle becomes larger.

In FIG. 4, as explained later, the effective discharge stroke of the pump 5 is set at the period between the crank angles from VC5 to V05. This effective discharge stroke period is determined much earlier than when the discharge stroke of the pump actually starts (for example, in FIG. 4, the effective discharge stroke period is determined at a crank angle QT in FIG. 4, and QT is about 360° BTDC). In order to determine the effective discharge stroke period at the crank angle QT, estimation of the valve timing is performed at VLT and occurs earlier than QT.

Figure 3:
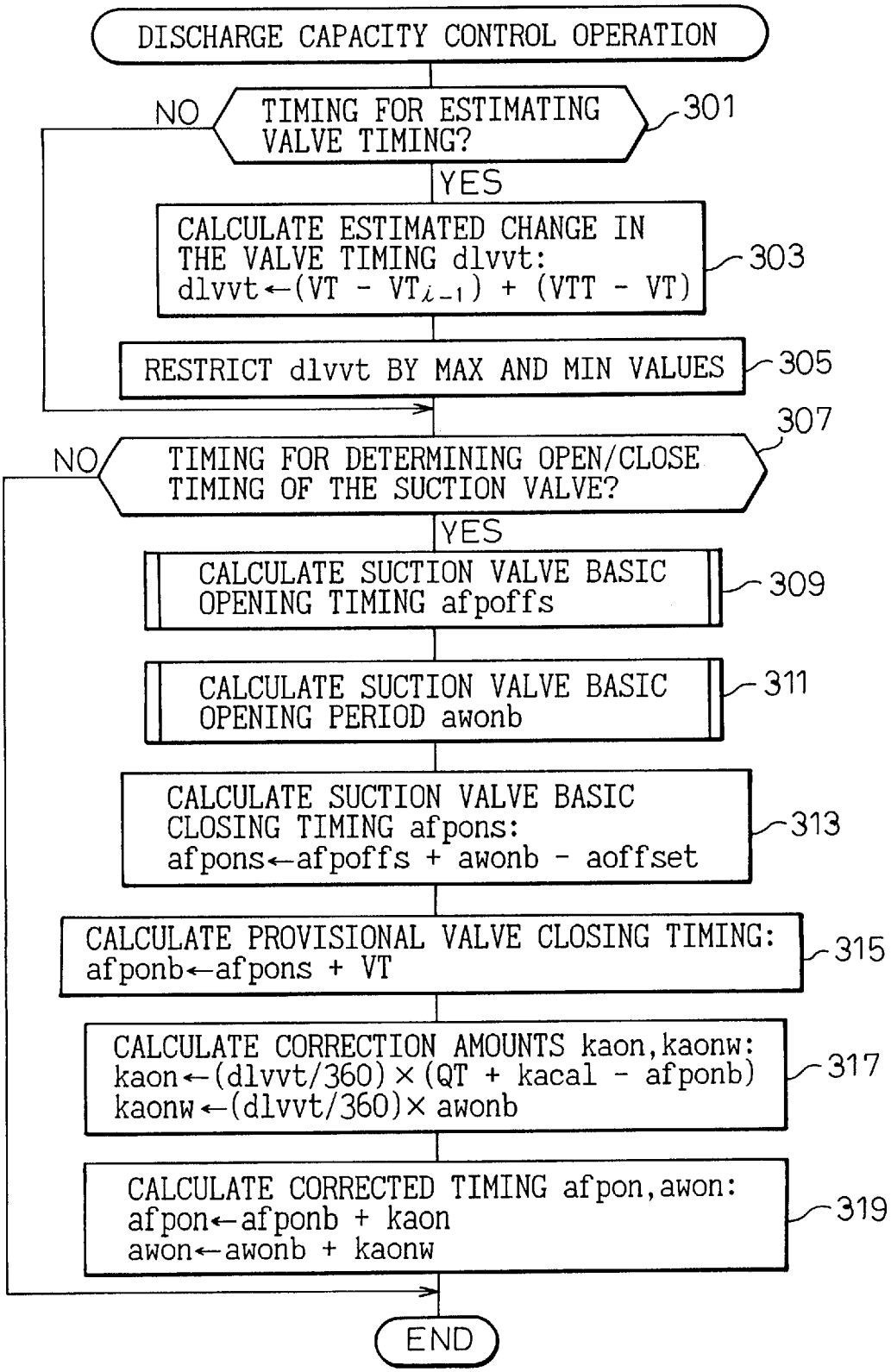
FIG. 3 is a flowchart illustrating a control operation of the pump discharge capacity based on the estimated change in the valve timing of the engine.

FIG. 3 is flowchart explaining the actual operation for determining the effective discharge stroke of the pump according to the embodiment. The operation in FIG. 3 is performed by a routine executed by the ECU 20 at every predetermined crank angle.

In FIG. 3, at step 301, the ECU 20 determines whether the estimation of the valve timing should be performed, i.e., whether the present crank angle CA is equal to VLT in FIG. 4 (in this embodiment, VLT is set at about 420° BTDC). If it is the timing for estimating the valve timing at step 301, the estimated amount dlvvt of the change in the valve timing when the crankshaft rotates 360° from the current crank angle is calculated at step 303 by $$dlvvt=(VT-VT_{i-1})+(VTT-VT).$$

VT in the formula is a value of the current valve timing and $VT_{i-1}$ is a value of the valve timing at 360° crank angle before. VTT is a current value of the target valve timing. The above formula is obtained through experiment. Namely, it was found through experiment that the amount of the change dlvvt in the valve timing during 360° rotation of the crankshaft from the current position is approximately equal to the value obtained by adding the amount of the deviation (VTT−VT) of the current valve timing from the target valve timing to the amount of the change ($VT-VT_{i-1}$) in the valve timing during the last 360° rotation of the crankshaft. The VTT and VT in the above formula is expressed by the amount of advance in the valve timing from the most retarded valve timing and, therefore, if the current valve timing is most retarded, VT becomes 0.

Next, at step 305, the value of the estimated amount of change dlvvt is restricted by a maximum value α (when the valve timing is advancing) and a minimum value β (when the valve timing is retarding). Namely, if dlvvt is larger than a or smaller than β, the value of dlvvt is set at α (for example, α≡5°) or β (β≡−10°). The maximum value a and the minimum value β corresponds to the maximum operating speed of the variable valve timing device 30 during the valve timing advancing operation and the valve timing retarding operation, respectively.

After calculating the estimated amount dlvvt of the change in the valve timing, it is determined at step 307 whether the current crank angle CA reaches the crank angle QT at which the close/open timing of the suction valve 5*a* of the pump 5 should be determined and, if CA=QT, the close/open timing of the suction valve 5*a* is calculated by steps 309 through 319.

Namely, at step 309, a basic opening timing (crank angle) afpoffs of the suction valve 5*a* is calculated in accordance with the target discharge capacity and the engine speed (i.e., running speed of the pump 5). The basic valve opening timing afpoffs is a opening timing of the suction valve 5*a* (i.e., a crank angle at which the solenoid actuator 51*a* is de-energized) suitable for obtaining the target discharge capacity when the valve timing is most retarded (FIG. 4). The basic valve opening timing afpoffs was determined in advance by an experiment in which a suitable valve opening timing for obtaining the target discharge capacity is determined under various combinations of the engine speed and the common rail pressure while keeping the valve timing at the most retarded timing. The obtained values of afpoffs are stored in the ROM of the ECU 20 in the form of a numerical map using the target discharge capacity, engine speed and common rail pressure as parameters.

At step 311, a basic closing period awonbs of the suction valve 5*a* (i.e., the period for energizing the solenoid actuator 51*a*) required for obtaining the target discharge capacity in the reference condition (i.e., when the valve timing is most retarded, refer to FIG. 4) is determined. Similarly to the values of afpoffs, the values of awonbs has been determined through experiment and stored in the ROM of the ECU 20 in the form of a numerical map using the target discharge capacity, engine speed and common rail pressure.

Further, at step 313, a basic valve closing timing (a crank angle at which the solenoid actuator 51*a* is energized) afpons in the reference (most retarded valve timing) condition is calculated from the basic valve opening timing afpoffs and the basic valve closing period awonbs by $$afpons=afpoffs+awonbs-a\ offset.$$

aoffset is the amount of offset of the cam nose of the driving cam 51*b* from the reference position of the camshaft. The closing timing afpons and the opening timing afpoffs calculated at steps 309 and 313 are the closing/opening timing of the suction valve 5*a* required for obtaining the target discharge capacity of the pump 5 under the reference valve timing condition (the most retarded valve timing condition). Therefore, in the valve timing conditions other than the reference valve timing condition, it is necessary to correct the closing timing afpons and the opening timing afpoffs of the suction valve in accordance with the actual valve timing.

Though the basic valve closing timing afpons is determined from the basic valve opening timing afpoffs in the above calculation, in the following calculation, the valve closing timing is determined from the valve opening timing in order to adjust the closing and opening timing of the suction valve in accordance with the valve timing.

For this purpose, a provisional valve closing timing afponb, under the current valve timing, is calculated at step 315. The provisional valve closing timing afponb is a crank angle at which the amount of cam lift of the driving cam becomes the same as that of the basic valve closing timing afpons. The provisional valve closing timing afponb is calculated by $$afponb=afpons+VT.$$

Further, at step 317, a correction amount kaon for correcting the provisional valve closing timing afponb in accordance with the estimated amount dlvvt of the change in the valve timing is calculated by $$kaon=(dlvvt/360)\times(QT+kacal-afponb).$$

The first term of the above formula represents the amount of the change in the valve timing per 1° rotation of the crankshaft and the second term thereof represents the angle of rotation of the crankshaft in the period from the crank angle at which the current valve timing VT is detected (i.e., the crank angle VLT) to the calculated provisional valve closing timing afponb (kacal is a crank angle between VLT and QT).

The amount (QT+kacal−afponb) represents the angle of rotation of the crankshaft from the crank angle VLT to the provisional valve closing timing afponb when it is assumed that the valve timing VT is not changed. However, in the actual operation, the valve timing changes even during the period the crankshaft rotates from the crank angles VLT to afponb. Therefore, in order to obtain the amount of cam lift same as that of the provisional valve closing timing (i.e., the amount of cam lift same as that of the basic valve closing timing afpons), it is necessary to correct the angle of rotation (QT+kacal−afponb) of the crankshaft based on the change in the valve timing in this period of crankshaft rotation. For example, if the valve timing advances by ΔVT during this period, the period (QT+kacal−afponb) must be shortened by ΔVT in order to obtain an amount of the cam lift the same as that of the basic valve closing timing afpons. Similarly, if the valve timing retards by ΔVT during the period, the period (QT+kacal−afponb) must be prolonged by ΔVT. Since the valve timing is now changing at the rate (dlvvt/360) per 1° rotation of the crankshaft, the total amount of change in the valve timing during the period (QT+kacal−afponb) becomes kaon calculated by the above formula. In other words, the kaon is the amount required for correcting the provisional valve closing timing afponb so that the amount of the cam lift at the corrected valve closing timing becomes the same as that of the basic valve closing timing afpons even if the valve timing is changing.

Similarly to the above, since the basic valve opening timing afpoffs also changes in accordance with the change in the valve timing, the valve closing period awonb must be corrected in accordance with the valve timing. Therefore, at step 317, the correction amount kaonw for the basic valve closing period awonb is calculated in the manner similar to kaon, i.e., by $$kaonw=(dlvvt/360)\times awonb$$

Finally, at step 319, the actual valve closing timing (the crank angle at which the solenoid actuator 51*a* is energized) afpon and the actual valve closing period (the angle of the crankshaft rotation during which the solenoid actuator is kept energized) awon are calculated by $$afpon=afponb+kaon,$$

and $$awon=awonb+kaonw.$$

When the valve closing timing afpon and the valve closing period awon are calculated at step 319, the solenoid actuator 51*a* of the suction valve 5*a* is energized and de-energized based on the calculated values of afpon and awon by a suction valve control operation executed by the ECU 20 separately (not shown). Namely, in the suction valve control operation, the ECU 20 starts to energize the solenoid actuator 51*a* when the crank angle reaches afpon and continues to energize the same until the crankshaft rotates an angle awon. By this suction valve operation, the amount of the change in the cam lift of the driving cam 51*b* becomes the same as that in the reference valve timing condition (D1 in FIG. 4) even when the valve timing is changing. Therefore, the actual discharge capacity of the pump 5 always becomes the target discharge capacity. Namely, according to the present embodiment, the discharge capacity of the high pressure fuel pump 5 is always adjusted to the target discharge capacity regardless of the change in the valve timing of the engine.

In the above embodiment, both of the valve closing timing (the crank angle at which the solenoid actuator 51*a* is energized) and the valve opening timing (the crank angle at which the solenoid actuator 51*a* is de-energized) are changed in accordance with the valve timing of the engine. However, if the amount of the change in the cam lift of the driving cam 5*b* during the effective discharge stroke of the pump 5 (the valve closing period, i.e., the period in which the solenoid actuator 51*a* is energized) is maintained at a same value, the discharge capacity of the pump becomes always the same. Therefore, either of the valve closing timing (i.e., the start of the effective discharge stroke) and the valve opening timing (i.e., the end of the effective discharge stroke) may be fixed if the length of the effective discharge stroke (i.e., the length of the period in which the solenoid actuator 51*a* is kept energized) is adjusted in accordance with the valve timing in such a manner that the amount of the change in the cam lift of the driving cam 5*b* becomes the same as that in the reference valve timing condition.

Further, although a four-cylinder internal combustion engine is used in the above embodiment, the present invention can be applied to engine having cylinders of different numbers. Also, the present invention can be applied to a diesel engine as well as a gasoline engine. Further, the present invention can be equally applied to an engine equipped with intake port fuel injection valves which inject fuel into the intake ports of the respective cylinders as well as an engine equipped with direct cylinder fuel injection valves which inject fuel directly into the cylinders.

What is claimed is:

1. A fuel pump control system for an internal combustion engine provided with variable valve timing setting means for adjusting the valve timing of the engine to a target valve timing determined by the operating condition of the engine by changing a rotational phase of the camshaft of the engine, the fuel pump control system comprising a discharge capacity control means for controlling the discharge capacity of a positive-displacement type fuel pump, which operates synchronously with the rotation of the camshaft of the engine, to a predetermined target discharge capacity, wherein said discharge capacity control means controls the discharge capacity of the fuel pump to the predetermined target discharge capacity by changing timing of at least one of start and end of an effective discharge stroke of the pump in accordance with the change in the rotational phase of the camshaft relative to the crankshaft.

2. A fuel pump control system as set forth in claim 1, wherein the discharge capacity control means estimates an actual valve timing of the engine at a predetermined time elapsed from the present and controls the discharge capacity of the fuel pump to the predetermined target discharge capacity by changing timing of at least one of start and end of an effective discharge stroke of the pump in accordance with the estimated actual valve timing of the engine.

3. A fuel pump control system as set forth in claim 2, wherein the discharge capacity control means estimates the actual valve timing of the engine after the predetermined time elapsed based on the current actual valve timing and the target valve timing.

* * * * *